United States Patent [19]

Schimmel

[11] Patent Number: 4,465,257

[45] **Date of Patent: * Aug. 14, 1984**

[54] CONCRETE FORMING STRUCTURE HAVING A DOUBLE HINGE FILLER

[75] Inventor: Vernon R. Schimmel, Lincolnwood, Ill.

[73] Assignee: Symons Corporation, Des Plaines, Ill.

[ * ] Notice: The portion of the term of this patent subsequent to Dec. 6, 2000 has been disclaimed.

[21] Appl. No.: 338,345

[22] Filed: Jan. 15, 1982

[51] Int. Cl.[3] ..... E04G 15/06; B28B 7/30

[52] U.S. Cl. ..... 249/11; 249/27; 249/170; 249/182; 249/185

[58] Field of Search ..... 249/170, 171, 172, 185, 249/11, 12, 27, 182

[56] References Cited

U.S. PATENT DOCUMENTS

| | | | |
|---|---|---|---|
| 1,168,659 | 1/1916 | McArthur | 249/182 |
| 2,557,631 | 6/1951 | Callan | 249/39 X |
| 3,206,156 | 9/1965 | Johnson et al. | 249/185 |
| 3,357,673 | 12/1967 | Williams | 249/194 |
| 3,676,536 | 7/1972 | Shelley | 249/185 X |
| 3,696,177 | 10/1972 | Holland | 249/11 X |
| 3,742,102 | 6/1973 | Stickler | 264/256 X |
| 4,055,321 | 10/1977 | Schimmel | 249/171 X |
| 4,210,306 | 7/1980 | Schimmel | 249/196 |

*Primary Examiner*—Donald E. Czaja
*Assistant Examiner*—James C. Housel
*Attorney, Agent, or Firm*—Charles F. Meroni, Jr.

[57] ABSTRACT

A concrete forming structure including a collapsible form having at least one form panel section and a rigid corner adjacent thereto and with the panel section having a forming face. A two-way hinge filler structure between the section and the rigid corner. The hinge filler structure including a series of hinge plates with a pair of the hinge plates being attached to the form. The hinge plates including a pair of spaced hinges joining the hinge plates in hinged assembly together and with the hinges lying in a plane common to the forming face of the section. Means is provided for holding the panel section in a predetermined position to facilitate the pouring of the concrete and with the means being releasable. The panel section being pivotal on the hinges to effect disengagement of the panel section from the poured concrete. The hinges being cooperable with the hinge plates and the panel section to allow the panel section to collapse and move after release of the means for allowing the panel section to be readily disengaged from the thus formed poured concrete.

24 Claims, 11 Drawing Figures

CONCRETE FORMING STRUCTURE HAVING A DOUBLE HINGE FILLER

The present invention relates generally to concrete forms and has particular reference to several new and improved articulated collapsible forms which are adapted for use in the formation of concrete structures such as a concrete corewall shaft, a tunnel, and concrete walls with or without pilasters. When the forms are used to provide a rectangular outline of an inside wall surface of a corewall, the corewall can be formed by pouring wet concrete around the form. With the unique two-way hinge construction that is provided in the various types of forms herein disclosed, the forms can be collapsed inwardly away from the formed walls so that the form is loosened from the hardened corewall-forming concrete and may then be shifted away from the formed wall into a position for use in connection with a subsequent concrete pour, depending upon whether the corewall to be formed is to extend vertically or horizontally.

Concrete corewalls of the character under consideration are commonly employed in the erection of high-rise apartment and other buildings in the production of stairwells, elevator shafts, and the like. Corewalls are also cast in horizontal position in connection with the creation of culverts, tunnels, or similar structures.

Heretofore it has been the practice, when constructing an articulated collapsible concrete form for the inside surfaces of a rectangular corewall, to utilize a hinge joint at the mid-point of each of the two long sides of the rectangular form so that when the joints are broken inwardly the articulated form collapses to produce a smaller form structure which has the outline of two truncated triangles which are connected in tandem fashion with their truncated corners joined together. The overall outline of such a collapsed form structure being smaller than the outline of the expanded form structure enables the collapsed structure to clear the walls of the hardened concrete of the corewall so that the collapsed form structure may be shifted longitudinally along the corewall to a new position for a subsequent concrete pour or for removal purposes. Other types of collapsible concrete forms that have been used before are also shown in my U.S. Pat. No. 4,055,321, wherein three-way hinge assemblies are disclosed.

An articulated collapsible inside form structure of the character said forth above has certain limitations and an important object of this invention is to provide a new and improved two-hinge assembly that can be used in a number of different types of forms for forming a variety of concrete wall structures.

An important object of this invention is to provide an improved two-way hinge assembly for releasing corewall gang forms.

Another important object of this invention is to provide a new and improved two-way assembly in combination with an appropriate concrete form structure which is operable to release core forms after wet concrete has hardened to form elevator shafts and the like without the necessity of disassembly of the components of the concrete form.

Still another important object of this invention is to provide a new and improved two-way hinge assembly in combination with an appropriate concrete form structure which is operable to release square cornered ganged tunnel or culvert forms without the necessity of disassembly of the concrete form.

Another and still further object of this invention is to provide a new and improved two-way hinge assembly in combination with an appropriate concrete form structure which is operable to release vertical wall gang forms where their length dimension is confined between two wall protrusions such as pilasters, intersecting walls or inside wall corners.

According to important features of my invention I have provided a concrete forming structure including a collapsible form having at least one form panel section and a rigid corner adjacent thereto and with the panel section having a forming face. A two-way hinge filler structure between the section and the rigid corner. The hinge filler structure including a series of hinge plates with a pair of the hinge plates attached to the form. The hinge plates including a pair of spaced hinges joining the hinge plates in hinged assembly together and with the hinges lying in a plane common to the forming face of the section. Means for holding the panel section in a predetermined position to facilitate the pouring of the concrete and with the means being releasable. The panel section being pivotal on the hinges to effect disengagement of the panel section from the poured concrete. The hinges being cooperable with the hinge plates and the panel section to allow the panel section to collapse and move after release of the means for allowing the panel section to be readily disengaged from the thus formed poured concrete.

According to other features of this invention, there is provided a new and improved two-way hinge filler structure for use in combination with a variety of different types of concrete forms including a form for forming elevator shafts, a form for forming tunnel walls, and a form for forming concrete wall structures such as ones having intersecting walls or inside wall corners.

Still other features of this invention relate to a new and improved two-way hinge structure that includes two hinges which are positioned in spaced relation to one another, and where one of the hinge plates has a swinging hinge plate leg disposed between the hinges, and another of the hinge plates has a clearance hinge plate leg disposed between one of the hinges and an end panel face of one of the panels.

Yet another important feature of this invention concerns a new and improved two-way hinge structure for a concrete form where back-up angles are welded to inside faces of adjacent clearance and swinging hinge plate legs, and with each of the angles having angle legs positioned in confronting relation to end faces of the panel sections, and fastener means being provided to join the angle legs in confronting assembly with the end faces of the panel sections. A still further feature of this invention is to provide a new and improved two-way hinge structure in combination with a tunnel form which is characterized by the hinge structure being positionable relative to adjacent panel sections for forming chamfered upper corners of a poured-in place concrete tunnel or culvert.

Still another object of this invention is to provide a two-way hinge assembly and concrete form combination which is designed to generate dimensional stripping relieve for ganged tunnel or culvert forms that contain chamfered corners, and likewise ganged vertical corewall forms that include chamfered corners and where the two-way hinge can be used to form an obtuse angle corner.

A still further object of this invention is to provide a two-way hinge assembly that can function to release and re-position square cornered corewall gang forms and straight wall ganged forms and straight wall ganged forms that are dimensionally captivated between intersecting walls, pilasters or any other wall protrusions.

An important object of this invention is to provide a new and improved two-way hinge assembly for use with a concrete form that foreshortens the concrete contact dimension of ganged forms after the concrete is placed.

Still another important feature of this invention relates to the development of a new and improved two-way hinge structure in combination with a form for forming a concrete corewall whereby the hinge structure can be sized so as to have widths that correspond to standard filler widths whereby the two-way hinge structure can also be used to function as a filler for forming various different sized concrete corewalls and for forming other concrete structures of varying types that may require the use of a two-way hinge filler structure. The provision of an inside articulated and collapsible concrete form for use in a corewall form and a tunnel wall form and in a wall form for forming walls with pilasters has now been briefly outlined above and which possesses the stated advantages and which constitutes the principal object of the present invention.

Numerous other objects and advantages of the invention, not at this time enumerated, will readily suggest themselves as the following description ensues.

The invention consists in the several novel features which are hereinafter set forth and are more particularly defined by the claims at the conclusion hereof.

In the accompanying five sheets of drawings forming a part of this specification, four illustrative embodiments of the invention are shown:

Figure 1:
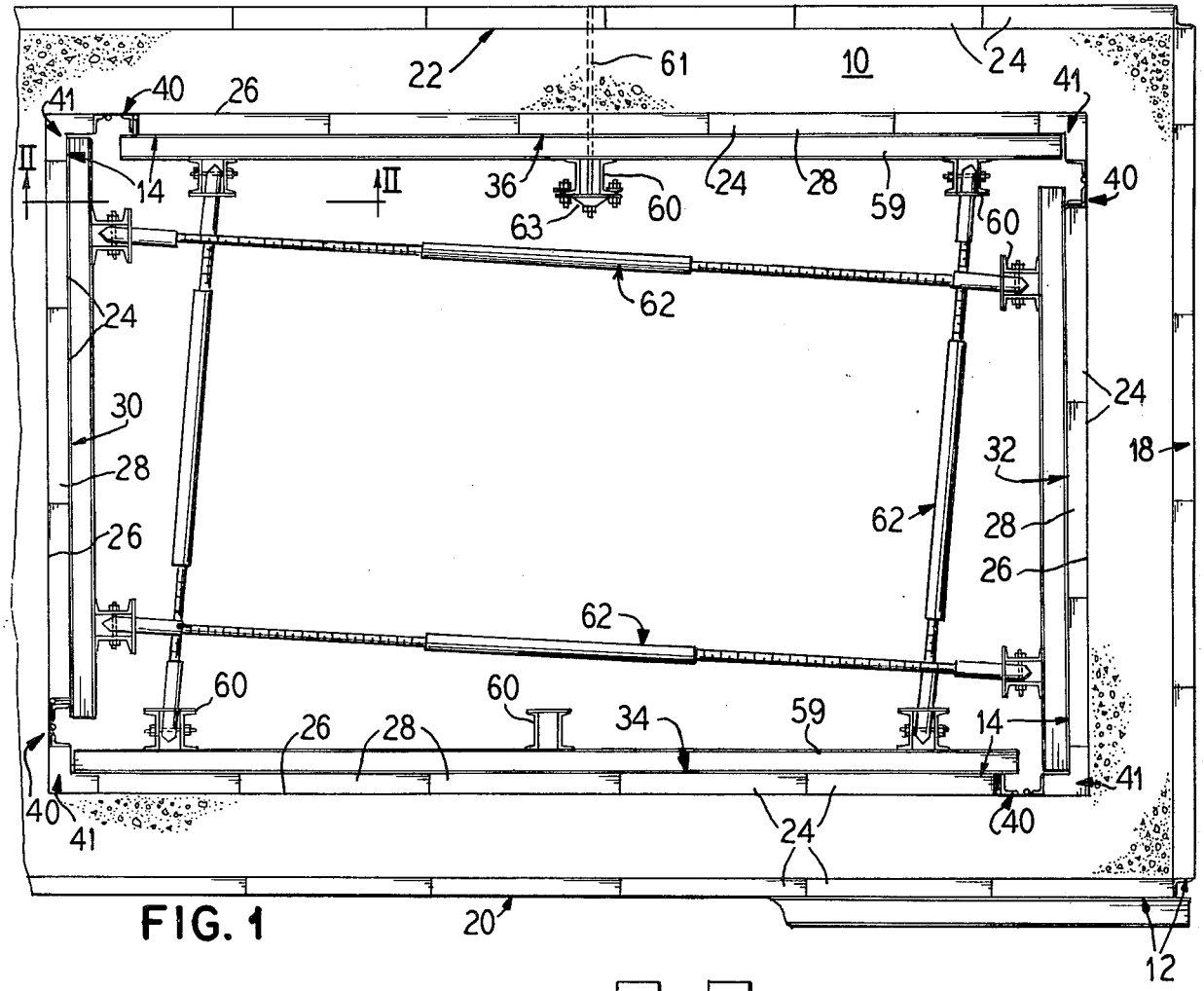
FIG. 1 is a schematic plan view looking downwardly into a vertically disposed concrete corewall showing the inside and outside form panels in position on the corewall preparatory to stripping the forms therefrom and illustrating a new and improved two-way hinge filler structure in assembly therewith.
Figure 2:
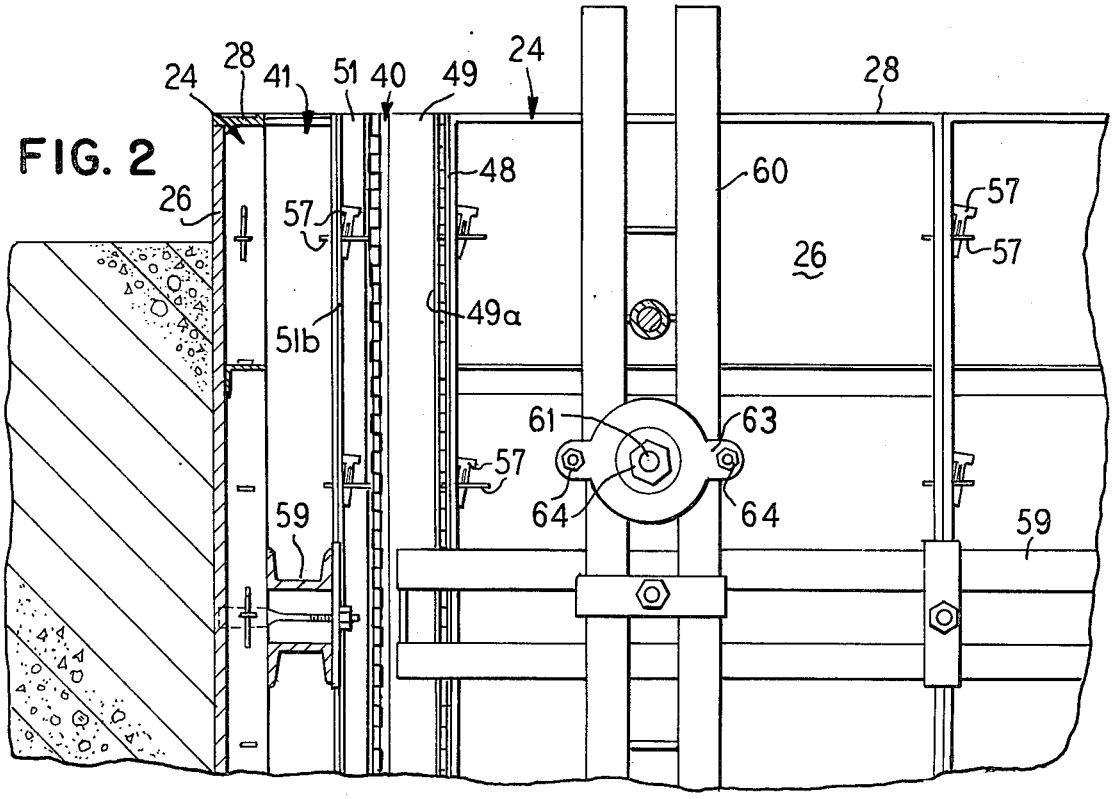
FIG. 2 is an enlarged fragmentary partially sectioned view taken on the line II—II of FIG. 1.
Figure 3:
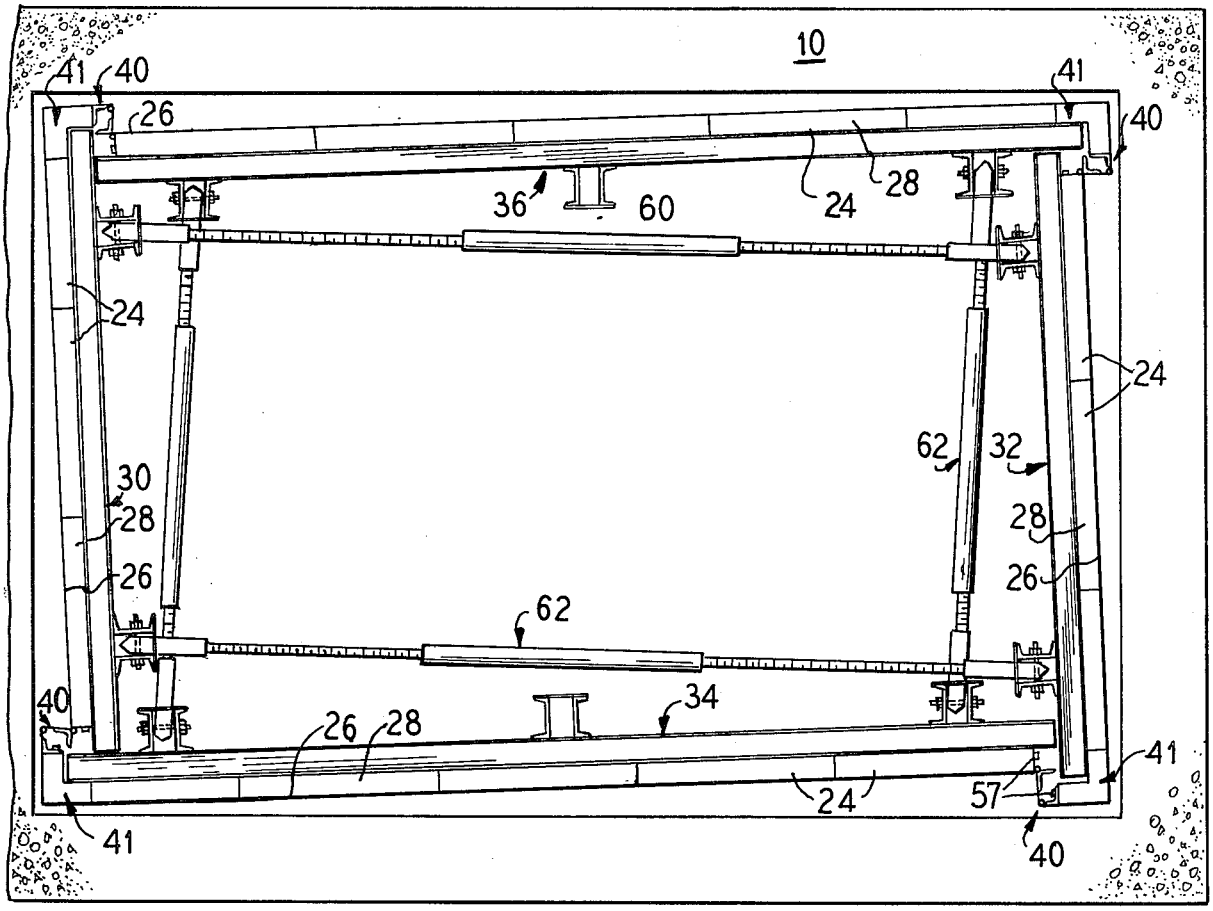
FIG. 3 is a schematic plan view similar to FIG. 1 but showing the concrete form structure in a collapsed position and illustrating how the panel sections can be collapsed away from the formed concrete walls by means of the two-way filler hinge structure embodying the present invention.

Referring now to the drawings in detail and in particular to FIGS. 1, 2 and 3, there is disclosed in these views a rectangular concrete corewall 10 which, for purposes of discussion herein, may be regarded as being a vertical elevator shaft or stairwell in a high-rise building which is under construction and is formed for the most part of concrete. The present invention is concerned with the construction of such a shaft-like corewall and this is accomplished in the usual manner by pouring wet concrete between a continuous rectangular outside form such as the illustrated form 12 and a continuous rectangular inside form.

The outside concrete corewall form 12 as described herein, is of conventional construction and is comprised of a series of quadrilaterally arranged form sides including left (not shown) and right sides 18 (see FIG. 1), and front and rear form sides 20 and 22. Each of the various form sides is comprised of a gang or series of panel sections or units 24, the number of units in each gang depending, of course, upon the dimensions of the corewall 10. In the illustrated outside concrete corewall form, the left and right form sides 18 embody five such panel units 24 each, while the front and rear form sides 20 and 22 embody six such panel units 24 each.

The particular panel units or sections 24 which are employed for the inside and outside concrete corewall forms 12 and 14 may vary widely, but for purposes of illustration herein, panel units of the STEEL-PLY type have been selected for exemplary illustration herein. This panel unit which has been found admirably well-adapted for use in connection with the present invention is a panel which is known as a STEEL-PLY panel. Such a panel is manufactured and sold by Symons Corporation. A typical STEEL-PLY panel unit is shown and described in U.S. Pat. No. 3,357,673, granted on Dec. 12, 1967, and entitled "Concrete Wall Form With A Particular Panel Hinge Arrangement." As shown throughout the drawings, each of the various panel units 24 regardless of whether they be associated with the inside concrete corewall form 14 or the form 12, includes a multi-ply plywood facing 26 and a marginal steel frame 28.

The inside concrete form 14 is of novel construction and it is essentially an articulated form which is collapsible as will be pointed out in detail hereafter and consists of left and right form sides 30 and 32, and front and rear form sides 34 and 36, adjacent panel units being connected together by novel two-way off-corner steel hinge assemblies or structures or hinge filler 40. The assemblies or structures or fillers 40 are also known and identified herein as haunch-hinge fillers. For convenience of illustration, each of these last mentioned form sides 30, 32, 34, and 36 of the inside corner corewall 14 is comprised of a single STEEL-PLY panel unit 24, although if the size of the corewall 10 requires it, any of all of these form sides may be comprised of an appropriate number of STEEL-PLY panel units in gang or series form.

The inside concrete form 14 is provided with four rigid right angle corners 41. The hinge assemblies 40 are disposed between the corners 41 and the adjacent panel sections or panel units 24. According to important features of this invention, the two-way hinge assemblies 40 are disposed in adjacency to the corner rather than forming part of the corner as shown in FIGS. 1–3 of my U.S. Pat. No. 4,055,321. One of the advantages of this construction is that the contractor can be assured of being able to produce a rectangular corewall having inside right angled concrete corners, because of the rigidity of the rigid corners 41.

Figure 4:
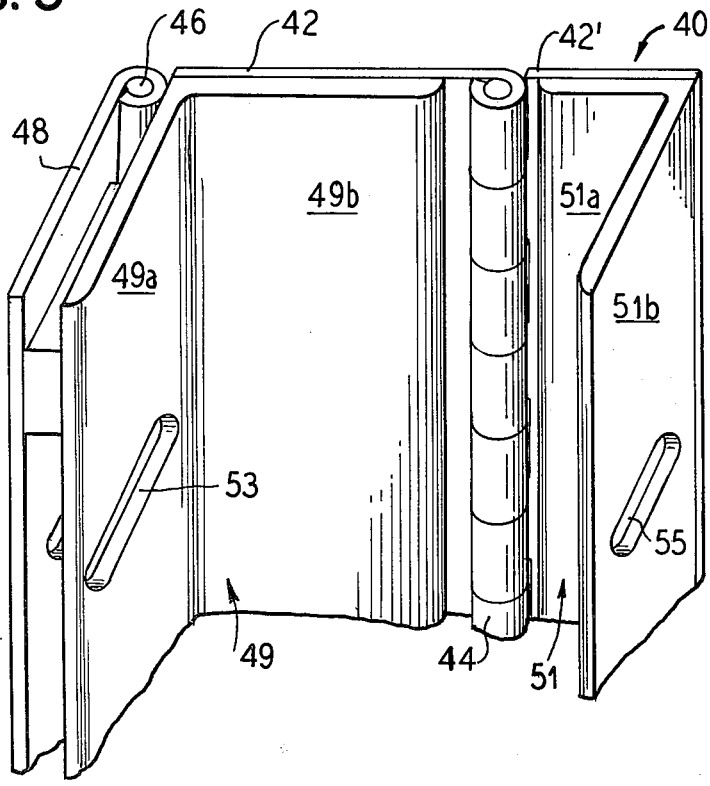
FIG. 4 is an enlarged fragmentary perspective view of one of the two-way hinge filler assemblies shown in the preceding figures.

Referring now additionally to FIG. 4 of the drawings, each of the two-way off-corner hinge assemblies 40 is preferably formed of stainless steel and involves in its general organization a pair of elongated main hinge leaves or plates or plate legs 42 and 42' which are connected together by their proximate side edges by a piano-type hinge 44. The leg 42 is a swinging leg and the leg 42' is a clearance leg. The leg 42 is twice as long as clearance leg 42'. Pivotally connected to the distal edge of one of the main hinge leaves or plates 42 by means of a piano-type hinge 46 is a secondary hinge leaf 48 of a shorter extent than the main hinge leaf 42. As shown in FIGS. 1 and 4, this secondary hinge leaf or plate 48 is designed for attachment to the margin of an adjacent panel 24. A pair of steel back-up angles 49 and 51 are provided. The angle 49 has angle legs **49*a* and 49*b* and leg 49*b* is welded to plate leg or swinging leg 42. The angle 51 has angle legs 51*a* and 51*b* and leg 51*a* is welded to the clearance leg 42'. Angle legs 49*a* and 51*b* each have bolt slots 53 and 55 (FIG. 4) and conventional wedge bolts 57 are engageable therethrough for fastening them to adjacent structures in different arrangements as shown throughout the Figures. In FIGS. 1, 2 and 3, the plate leg 48 is secured to the adjacent panel 24 and the angle leg 51*b* is secured by the wedge bolts 57 through the slots 55 to the confronting rigid corner 41 in a conventional manner. In FIG. 2, it can be seen there how the wedge bolts 57** can be engaged together to lock components together in a manner well known in this art.

With reference to FIG. 4 it will be noted that solid metal spacers are welded to hinge leg 48 to provide a back-up for rigid angle leg **49*a* to hold the main hinge leaf or leg 48 in parallel relationship with respect to the angle leg 49*a* to facilitate securement of the parallel elements with the adjacent panel 24 as seen in FIG. 1 by means of the wedge bolts 57** as previously described.

In FIG. 2 the concrete forming structure is shown partially in section and the various means for reinforcing the forms are illustrated in greater detail. To this extent, it will be noted that horizontal U-shaped walers 59 are secured to the panel units 24 by means of suitable fasteners in a conventional manner. Also mounted in abutment against the walers 59 is a strongback structure 60 that is held in place by a wall tie 61 which serves to hold the inside and outside forms in a predetermined position and more particularly for affixing the position of the form panel sections 24 in place. The wall ties 61 are of a conventional construction.

The rigidity of the inside corewall form 14 with respect to the outside form 12 is maintained by a series of adjustable turnbuckles 62 which are of a conventional construction. These turnbuckles can be arranged in any number of different ways to prop the core forms and particularly the inside core form 14. When it is desired to knock down the core form 14, the turnbuckles 62 can be operated so as to contract and to cause the two-way hinge filler structure 40 to collapse. When the turnbuckles are in the position illustrated in FIG. 1, the two-way hinge filler structures serve a dual function in that not only do they serve to release when the turnbuckles 62 are actuated, but in addition they provide a filler for closing the gap between the corner 41 and the adjacent panel section 26 since the filler hinge structures 40 extend coextensively in height with the rigid corners 41 and the panels 24. These filler hinge structures 40 are sized so as to correspond in width to the ordinary filler sizes that are needed and commercially used today so that the filler hinge structure can also fill the filler function required in industry to fill gaps where a full size panel cannot be used to fit a required reduced dimension to produce a wall of a prescribed size. In order to cause the inside corewall form to collapse, it will be seen that the form is articulated and collapsible. Before the inside articulated and collapsible concrete form 14 can be collapsed, the wall tie 61 must be disconnected by removing the tie bearing plate 63 and the fasteners 64 securing these components in assembly. The collapsed position of the rectangular inside form 14 is shown in FIG. 3 where it will be observed that the wall ties 61 have been removed. Once the form 14 has been collapsed, a crane can be used to move the form to a new position for a further usage, if desired.

Figure 5:
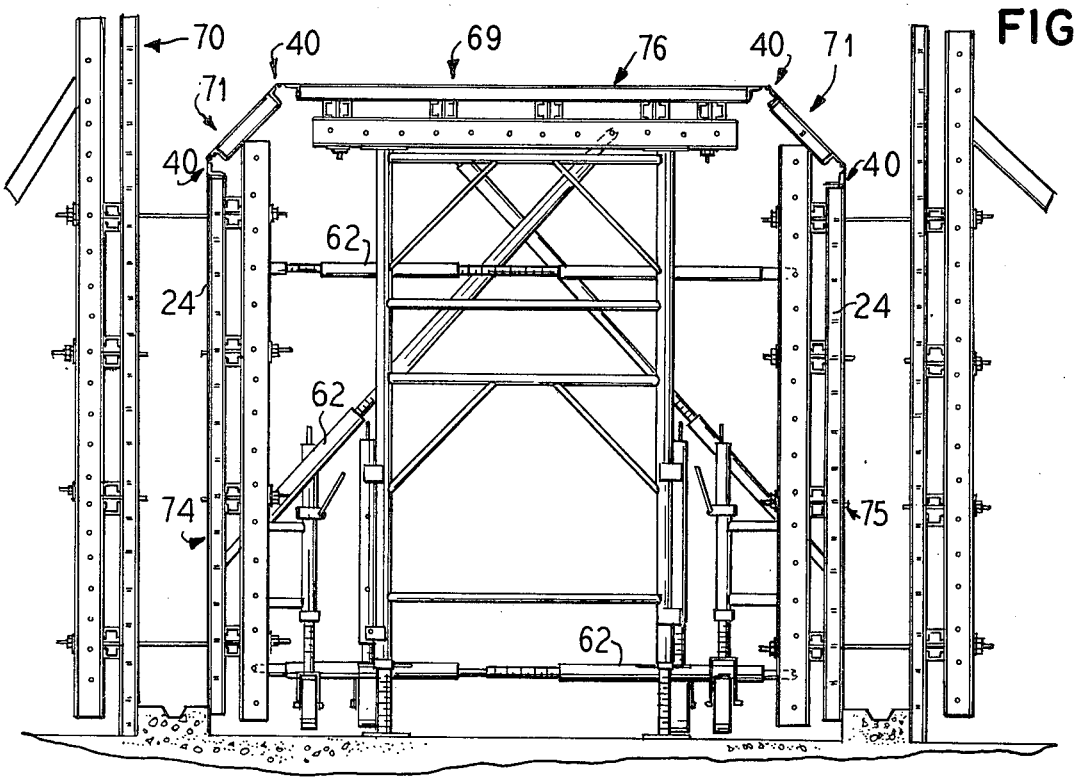
FIG. 5 is an enlarged fragmentary end view of a tunnel forming form structure in position with respect to spaced forms for forming a tunnel or culvert and illustrating the new and improved two-way hinge assemblies of the present invention.
Figure 6:
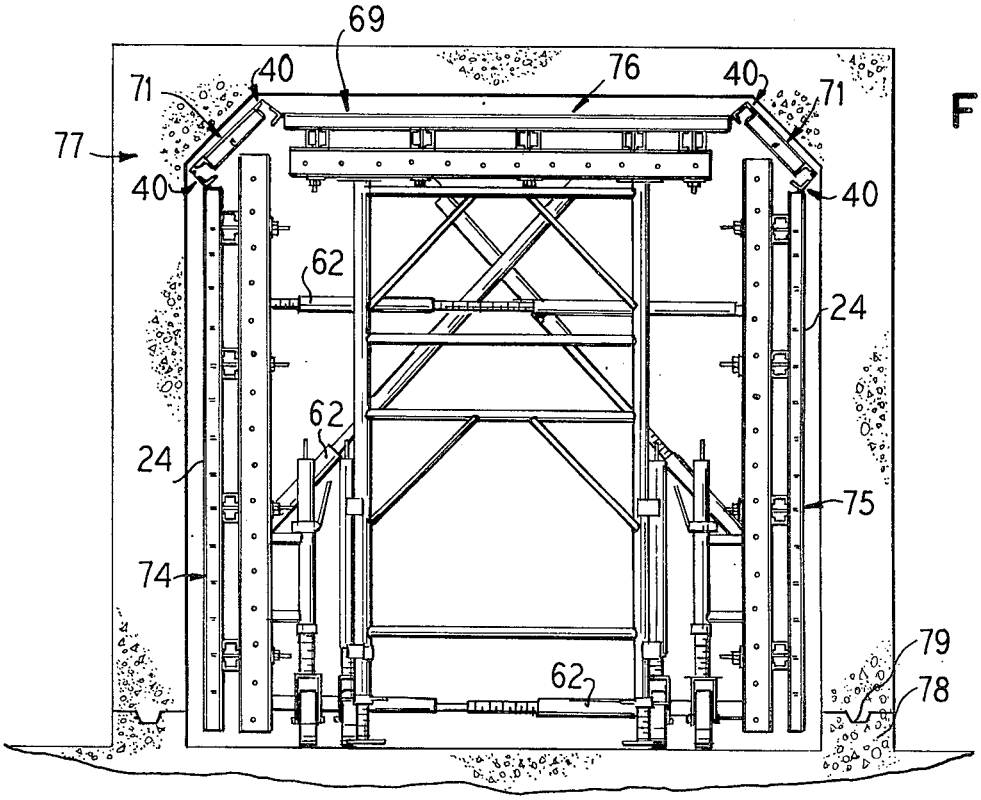
FIG. 6 is an enlarged fragmentary view similar to FIG. 5 only showing the tunnel or culvert form in combination with the two-way hinge assembly in a stripped-away position relative to the formed concrete tunnel.

In FIGS. 5 and 6, an inside articulated and collapsible concrete form 69 is illustrated for use with an outside form 70. According to important features of my invention, the inside form 69 has rigid right angled chamfered corners 71. Panels or panel units or sections 24 of the same construction as previously described, are mounted in adjacency to the corner 71. Still further, the two-way hinge filler structures 40 are provided at the juncture of the right side wall or sides 74 and 75 with the rigid right angled chamfered corners 71. Above the upright sides is a horizontal side 76 and it is joined at its opposite ends to the rigid right angled chamfered corners 71—71, all as seen in FIGS. 5 and 6. In FIG. 5, the inside articulated and collapsible concrete form for forming a tunnel wall 77 is illustrated. The tunnel wall that is thereafter formed by using the forms illustrated in FIG. 5 is shown in FIG. 6. In addition, the inside corewall form is shown in a collapsed position in FIG. 6. The collapsing of the form can be accomplished by collapsing the two-way hinge structure 40—40. These hinge structures operate in the same manner as previously described in connection with FIGS. 1–4 panels 24 to form the upright sides 74 and 75 and the deck or horizontal side 76 is achieved by the same procedures previously discussed herein. Also, the collapsing of the inside corewall form for forming the tunnel wall can also be brought about by operation of turnbuckle 62 in the same manner as previously described. To effect removal of the inside corewall form, the form upright sides 74 and 75 as well as the horizontal side 76 all must be collapsed and moved away to enable the inside tunnel form to be moved and disengaged from the formed tunnel 77. By this procedure, the collapsed tunnel form can be moved to a new position and then expanded using the turnbuckle 62 to cause the upright sides 74 and 75 and the horizontal side 76 to be moved into the position illustrated in FIG. 5 in readiness for a subsequent pour of concrete.

Figure 7:
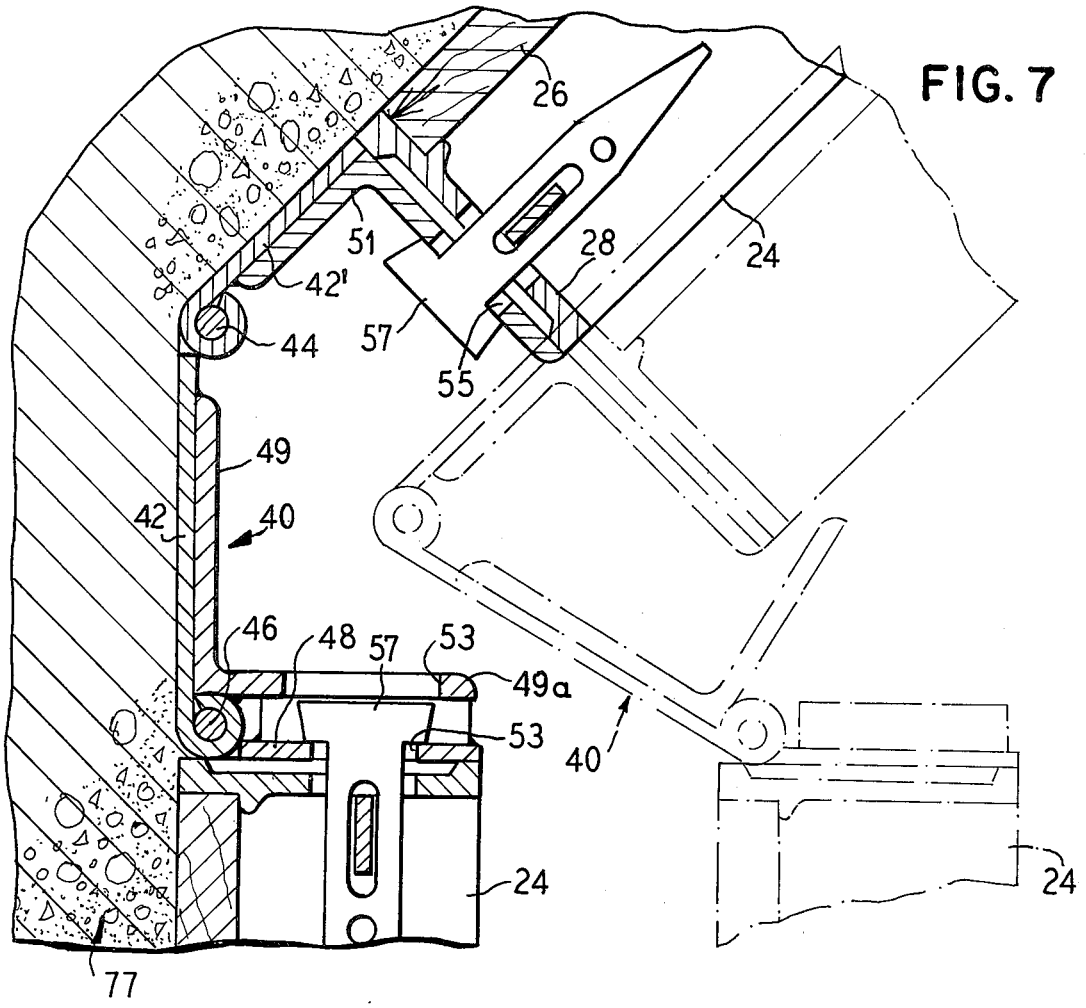
FIG. 7 is an enlarged fragmentary prospective view illustrated in full dotted lines showing how the hinge assembly can be collapsed away from a formed concrete tunnel or culvert.

As noted before, in FIG. 7 the two-way filler hinge structure 40 is illustrated in full and phantom lines with relation to the tunnel wall or culvert 77. The manner in which the two-way filler hinge structure operates during a pour to form a culvert or a tunnel is shown in FIG. 7 similar to the way that the hinge structure 40 operates in FIGS. 5 and 6. The enlarged Figure shows the collapsing action of the two-way hinge structure as it is retracted away from the formed concrete culvert or tunnel.

Figure 8:
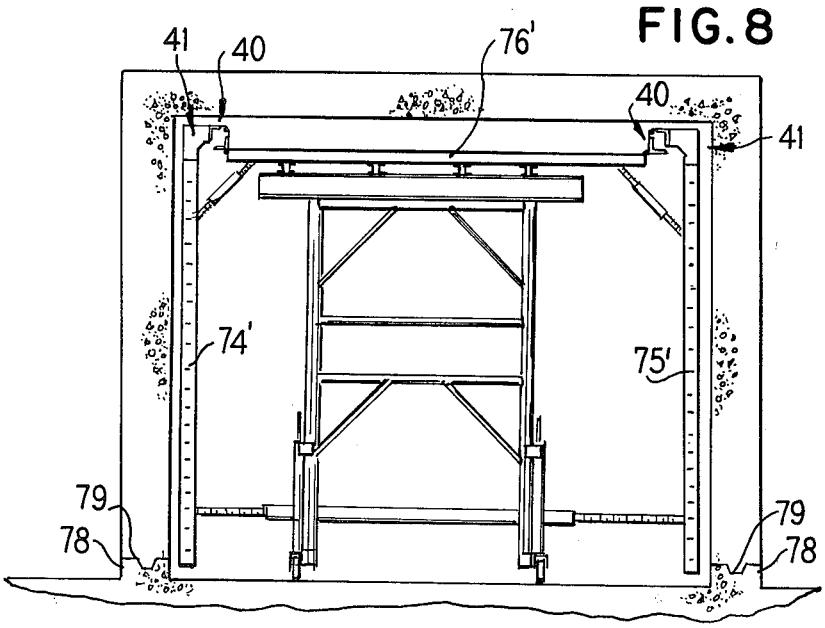
FIG. 8 is an enlarged fragmentary end view of a concrete form structure for forming a tunnel or a culvert and with the two-way hinge structure positioned as a filler in such manner as to form right angled corners.

In FIG. 8 a modified arrangement is illustrated where rigid right angle corners 41, upright sides 74' and 75' and the two-way filler hinge structures serve to join the rigid corners to opposite ends of a deck or horizontal sides 76'. By using a starter wall 78 as illustrated in FIG. 6 along with a cold joint 79, the upright sides 74' and 75' can be moved into position to permit the culvert or tunnel to be poured. Thereafter, by using the turnbuckles, the deck can be moved away from the upper inner surface of the culvert or tunnel and the entire form can be thereby released from the poured concrete and can be pulled into a new position for a subsequent pour. By using rigid right angle corners 41, square corners can be produced on the culvert or tunnel.

Figure 9:
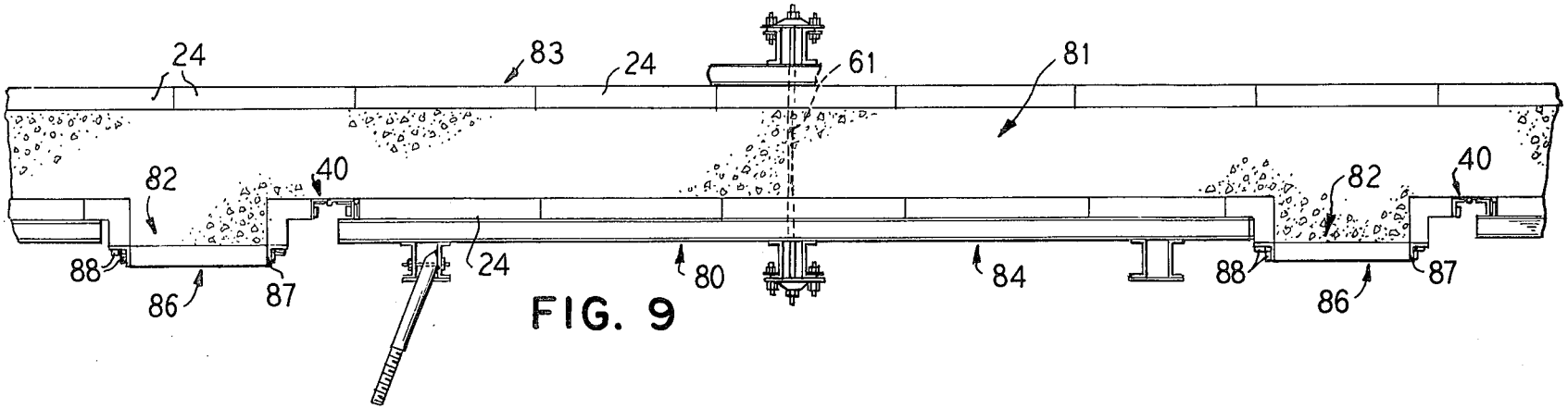
FIG. 9 is a fragmentary plan view of a concrete form structure for forming a concrete wall in combination with pilasters utilizing the new and improved two-way hinge fillers embodying features of this invention.
Figure 10:
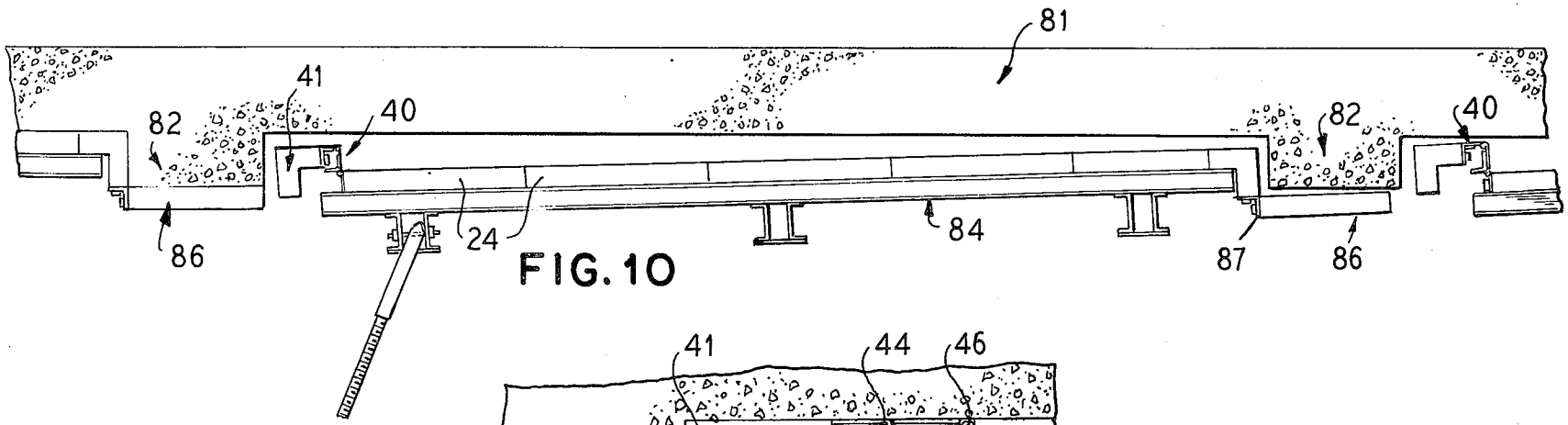
FIG. 10 is a plan view of the concrete form structure illustrated in FIG. 9 only illustrating the form in a stripped-away position relative to the formed concrete wall and the pilasters.
Figure 11:
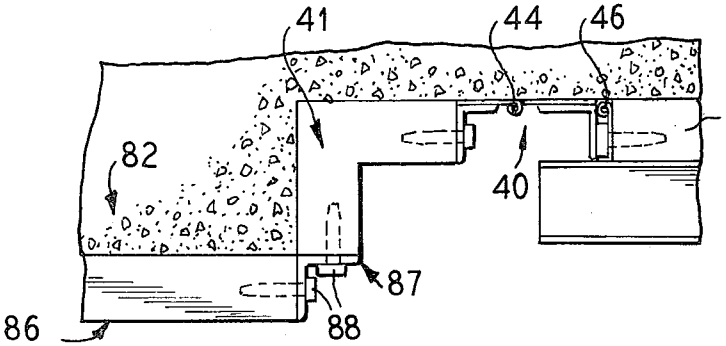
FIG. 11 is an enlarged fragmentary view showing the two-way filler hinge structure and its relationship with the concrete form as also seen in FIG. 9.

Still another form of my invention is illustrated in FIGS. 9, 10 and 11. In this instance, a form structure 80 is illustrated for forming a concrete wall 81 with spaced pilasters 82 integral therewith. Here an outer form 83 is employed which is comprised of a series of side-by-side panel units or panel sections 24 of the same type previously discussed before. An inner form 84 is also illustrated and it is similar to the inside form 14 previously discussed. Form 84 includes a series of panel units 24 which serve to coact with the two-way filler hinge structure 40 and rigid right angle corners 41. In addition a pilaster form unit 86 is provided for attachment to the rigid corner through the use of an attachment angle 87 (FIG. 11), and wedge bolts 88. In the arrangement shown in FIGS. 9, 10 and 11, it is now possible to form a wall with integral pilasters 82 and to then strip the inside form 84 by the use of the new and improved two-way hinge filler structure 40. Before the inside form 84 can be stripped away, the angles 87 must be detached at one end of the pilaster form 86 as illustrated in the right-hand side of FIG. 10. It will be appreciated that a wall tie 61 of the same type illustrated in FIG. 1 is used to hold the outside form 83 and the inside form 84 in fixed relation to allow the concrete to be poured.

In all forms of my invention, it is important that the hinges 44 and 46 lie in the plane of the forming face of the inside form so that the two-way filler hinge structure 40 can properly collapse and move away from the formed concrete to permit effective stripping of the form therefrom.

The two-way hinge structure 40 functions to release cubical ganged forms where walls and deck slab are poured monolithic in the construction of hi-rise motels, hotels, apartment buildings, etc. (Same function as in square corner tunnel application).

In all of the above release applications the two-way hinge structure 40 functions to foreshorten either the ganged form width, or length dimension without need to disconnect any part of the ganged unit structure.

The corner angles at which both the two-way hinge structure 40 functions are not limited to forty-five or ninety degrees. The two-way hinge structure will function to an 180 degree straight wall on down to an approximate 35 degree corner.

Stripping relief functions of either the two-way hinge structure 40 can be utilized in ganged form applications or hand set forming applications.

Any modular type panel unit 24 is preferably used in combination with the two-way filler hinge structure 40. Another type of panel unit that can be used is known as the VERSIFORM type. A VERSIFORM panel is a steel-clad panel consisting of a rectangular plywood facing which is bounded by a rectangular marginal steel frame. Such panels are manufactured and sold by Symons Corporation of Des Plaines, Ill., and for a full understanding of the nature of a VERSIFORM panel, reference may be had to a brochure which was published in 1974 by Symons Corporation and is entitled "Vertical Forming Systems".

Another important feature of the two-way filler hinge structure 40 is that it acts as a superior foreshortening means over the 3 hinge corner in my early '321 U.S. patent (supra). The structure 40 is also smaller and stronger and operates better in view of the fact that it is not located directly at the corner like the 3 hinge corner in my '321 U.S. patent. In use, the two-way filler hinge structure provides the contractor with a superior time savings feature enabling the contractor to set up and remove the forms in much less time over the prior art devices known to me. Also, the use of slip plates can now be avoided.

I claim:

1. In a concrete forming structure including a collapsible form having at least one form panel section and an angle-shaped rigid non-hinging corner adjacent thereto and with the panel section having a forming face, a two-way hinge filler structure between said section and said rigid corner and with two-way hinge filler structure and its hinging action being apart from the angle-shaped rigid non-hinging corner, the hinge filler structure including a series of hinge plates with a pair of the hinge plates attached to said form, the hinge plates including a pair of spaced hinges joining said hinge plates in hinged assembly together and with the hinges lying in a plane common to the forming face of said section, and means for holding said panel section in a predetermined position to facilitate the pouring of the concrete and with said means being releasable, said panel section being pivotal on said hinges to effect disengagement of the panel section from the poured concrete, the hinges being cooperable with the hinge plates and the panel section to allow the panel section to collapse and move after release of said means for allowing the panel section to be readily disengaged from the thus formed poured concrete.

2. The structure of claim 1 further characterized by the panel section and the rigid corner having confronting attachment faces, and means attaching said pair of hinge plates to said faces and with said one of the hinges being engaged in abutment with one of the faces and with said other of the hinges being spaced between said faces.

3. The structure of claim 1 further characterized as including a plurality of the panel sections and rigid corners and being arranged to act as a core form and with panel sections being collapsible on the hinges provided by said two-way hinge filler structures inside a poured and formed concrete formed about said core form for rapid removal of the form.

4. The concrete forming structure of claim 1 further characterized by said means for holding said panel section in a predetermined position comprising a series of releasable turnbuckles.

5. The concrete forming structure of claim 1 further characterized by said means for holding said panel section in a predetermined position comprising at least one wall tie for affixing the position of the form panel section.

6. The concrete form structure of claim 1 further characterized by the hinges being positioned in spaced relation to one another, one of the hinge plates having a swinging hinge plate leg disposed between the hinges, another of the hinge plates having a clearance hinge plate leg disposed between one of said hinges and an end panel face of the panel section.

7. In the concrete forming structure of claim 6 further characterized by the swinging hinge plate leg being approximately twice as long as the clearance hinge plate leg.

8. The concrete forming structure of claim 6 further characterized by the clearance hinge plate leg and the swinging hinge plate leg having back-up angles welded to inside faces of said legs, and with each of said angles having angle legs positioned in confronting relation to end faces, and fastener means joining said angle legs in confronting assembly with the end faces.

9. The concrete forming structure of claim 1 further characterized by the form being for a rectangular corewall and including four form sides arranged in quadrilaterial relationship and having four corners, the two-way hinge filler structures being located in adjacency to each of said corners and being offset relative thereto, said two-way hinge structures being of the haunch-type.

10. The concrete forming structure of claim 1 further characterized as including an inside articulated and collapsible concrete form for forming a tunnel or a culvert, said form comprising three form sides, the sides being joined by the square corners, the corners having right angled forming corner faces, and said two-way hinge filler structures each being positioned in offset adjacency relative to one of the square corners.

11. The structure of claim 1 further characterized by a pilaster form positioned at one side of said two-way hinge filler structure and with said corner being a component thereof; said forms being for forming a concrete wall in combination with integral pilasters.

12. The concrete forming structure of claim 1 further characterized by the collapsible form being particularly adapted for forming a concrete wall, a pilaster forming structure at one side of said collapsible form and with said corner comprising a portion thereof, the panel section being joined therewith by means of said two-way filler hinge structure, the corner section and the panel section being collapsible relative to one another on said hinges for releasing said forms.

13. An inside articulated and collapsible concrete form for forming a rectangular corewall, said form comprising four form sides and four angle-shaped non-hinging corners arranged in quadrilateral relationship, each side including an outwardly disposed facing with a marginal reinforcing frame having side and end rails, a two-way hinge structure for each side disposed apart from each angle-shaped non-hinging corner, each of the two-way hinge structures being generally coextensive in length with said sides, the hinge structure including a series of hinge plates with a pair of the hinge plates attached to said sides, the hinge plates including a pair of spaced hinges joining said hinge plates in hinged assembly together and with the hinges lying in a plane common to the forming face of at least one of said sides and means for holding said sides in a predetermined position to facilitate the pouring of the concrete and with said means being releasable, said sides being pivotal on said hinges to effect disengagement of the sides from the poured concrete, the hinges being cooperable with the hinge plates and the sides to allow the sides to collapse and move relative to one another after release of said means for allowing the sides to be readily disengaged from the thus formed poured concrete.

14. The form of claim 13 further characterized by said four corners each comprising a separate rigid right angle corner member.

15. The form of claim 14 further characterized by each of said corner members being joined at one edge by one of said sides at an opposite edge by one of said two-way hinge structures.

16. The concrete form of claim 13 further characterized by the hinges being positioned in spaced relation to one another, one of the hinge plates having a swinging hinge plate leg disposed between the hinges, another of the hinge plates having a clearance hinge plate leg disposed between one of said hinges and an end panel face of one of the panels.

17. In the concrete form of claim 16 further characterized by the swinging hinge plate leg being approximately twice as long as the clearance hinge plate leg.

18. The concrete form of claim 6 further characterized by the clearance hinge plate leg and the swinging hinge plate leg having back-up angles welded to inside faces of said legs, and with each of said angles having angle legs positioned in confronting relation to end faces of said sides, and fastener means joining said angle legs in confronting assembly with the end faces of said sides.

19. An inside articulated and collapsible concrete form for forming a tunnel wall, said form comprising three form sides and two angle-shaped rigid non-hinging corners arranged in u-shaped relationship, each side including an outwardly disposed facing with a marginal reinforcing frame having side and end rails, a two-way hinge structure for each of said three form sides and being disposed apart from each corner, each of the two-way hinge structures being generally coextensive in length with said sides, the hinge structures each including a series of hinge plates with a pair of the hinge plates attached to said sides, the hinge plates including a pair of spaced hinges joining said hinge plates in hinged assembly together and with the hinges lying in a plane common to the forming face of at least one of said sides and means for holding said sides in a predetermined position to facilitate the pouring of the concrete and with said means being releasable, said sides being pivotal on said hinges to effect disengagement of the sides from the poured concrete, the hinges being cooperable with the hinge plates and the sides to allow the sides to collapse and move relative to one another after release of said means for allowing the sides to be readily disengaged from the thus formed poured concrete.

20. The form of claim 19 further characterized by each of said corners comprising a separate rigid right angle corner member.

21. The form of claim 20 further characterized by each of said corner members being joined at one edge by one of said sides and at an opposite edge by one of said two-way hinge structures.

22. The concrete form of claim 19 further characterized by the hinges being positioned in spaced relation to one another, one of the hinge plates having a swinging hinge plate leg disposed between the hinges, another of the hinge plates having a clearance hinge plate leg disposed between one of said hinges and an end panel face of one of the panels.

23. In the concrete form of claim 22 further characterized by the swinging hinge plate leg being approximately twice as long as the clearance hinge plate leg.

24. The concrete form of claim 22 further characterized by the clearance hinge plate leg and the swinging hinge plate leg having back-up angles welded to inside faces of said legs, and with each of said angles having angle legs positioned in confronting relation to end faces of said sides and fastener means joining said angle legs in confronting assembly with the end faces of said sides.

* * * * *